US005476374A

United States Patent [19]

Langreck

[11] Patent Number: 5,476,374

[45] Date of Patent: Dec. 19, 1995

[54] AXIALLY PORTED VARIABLE VOLUME GEROTOR PUMP TECHNOLOGY

[76] Inventor: Gerald K. Langreck, W7474 W. Evens Bay Rd., Phillips, Wis. 54555

[21] Appl. No.: 347,887

[22] Filed: Dec. 1, 1994

[51] Int. Cl.[6] ..... F01C 1/08; F04C 15/04

[52] U.S. Cl. ..... 418/171; 418/32

[58] Field of Search ..... 418/171, 32, 19

[56] References Cited

U.S. PATENT DOCUMENTS

| | | | |
|---|---|---|---|
| 2,359,558 | 10/1944 | Holl . | |
| 2,509,321 | 5/1950 | Topanelian, jr. . | |
| 3,334,546 | 8/1967 | Vuolle-Apiala . | |
| 3,730,653 | 5/1973 | Drutchas et al. . | |
| 4,413,960 | 11/1983 | Specht | 418/171 |
| 4,420,292 | 12/1983 | Lutz . | |
| 4,501,535 | 2/1985 | Golobay . | |
| 4,887,956 | 12/1989 | Child . | |
| 5,032,069 | 7/1991 | Parsons . | |

FOREIGN PATENT DOCUMENTS

| | | | |
|---|---|---|---|
| 69205 | 10/1958 | France | 418/32 |
| 1781 | 1/1988 | Japan | 418/19 |

OTHER PUBLICATIONS

"Automotive Engineering", Jan. 1994, p. 84.

*Primary Examiner*—Charles Freay
*Attorney, Agent, or Firm*—Joel D. Skinner, Jr.

[57] ABSTRACT

A gear pump including a body, a port plate, a pair of gerotor-type rotors, one rotor being connected to a shaft, and a retaining assembly operative on the port plate to rotatably couple it to the body. The retaining assembly permits adjustment of axially oriented inlet and outlet ports disposed in the port plate to vary fluid flow from the pump. Both manually and automatically adjustable retaining assemblies are disclosed.

12 Claims, 9 Drawing Sheets

AXIALLY PORTED VARIABLE VOLUME GEROTOR PUMP TECHNOLOGY

BACKGROUND OF THE INVENTION

1. Field of the Invention

This invention relates to pump apparatus, and more particularly to a gerotor-type gear pump. The pump of this invention is particularly useful in applications such as transmissions, hydraulic pumps, oil pumps and the like used in the automotive and other industries.

2. Background Information

The term "Gerotor" was first used by Myron F. Hill to describe a geometry for mutually generative rotors in pumps and gears. Gerotor-type gear pumps comprise a gerotor set including an externally toothed inner gear-like rotor and an internally toothed outer rotor disposed about respective eccentric axes in an interior chamber of a housing. The rotating, meshed rotor teeth define a continuous series of expanding and contracting cavities in the chamber. The expanding cavities take fluid in from an inlet port and the contracting cavities force fluid out through an outlet port.

Although gerotor-type gear pumps are well known, existing devices and methods have significant limitations and shortcomings. Of particular importance are limitations concerning simplicity of design, flow control, and pump efficiency.

Examples of relevant apparatus and methods are disclosed in U.S. Pat. No. 2,509,321 to Topanelian, Jr. for a rotary fluid unit for take-off under variable control, in U.S. Pat. No. 4,420,292 to Lutz for bi-directional internal/external gear pump with advanced porting, and in U.S. Pat. No. 4,887,956 to Child for variable output oil pump.

Despite the need in the art for a gerotor-type gear pump which overcomes the disadvantages, shortcomings and limitations of the prior art, none insofar as is known has been developed or proposed.

Accordingly, it is an object of the present invention to provide a gerotor-type gear pump which utilizes variable axially oriented porting and variable flow control. It is a further object of this invention to provide an axially ported, variable flow gerotor-type gear pump which is automatically adjustable, highly efficient, has a simple economical design, and which overcomes the limitations and shortcomings of the prior art.

SUMMARY OF THE INVENTION

The apparatus of the present invention provides an axially ported, manually or automatically controlled, variable flow gerotor-type gear pump. The pump is useful in a variety of applications including automotive transmissions, power steering pumps and oil pumps.

In a basic embodiment the invention provides a gerotor pump, comprising a body having an annular interiorly disposed channel, a port plate manually rotatably connected to the body and covering the channel, the port plate having an inlet port and an outlet port communicatively connected to the channel, an outer rotor disposed in the channel, an inner rotor rotatably and centrally disposed with respect to the outer rotor and having a drive shaft axially connected thereto, and means to rotate the port plate.

In a first preferred embodiment, the invention provides an axially ported, manually adjustable variable volume gerotor fluid pump, comprising:

(a) a body having an annular interiorly disposed channel;

(b) a port plate coupled to the body and covering the channel, the port plate having axially oriented fluid inlet and outlet ports communicatively connected to the channel;

(c) a gerotor set including an outer rotor disposed in the channel and an inner rotor rotatably and centrally disposed with respect to the outer rotor and having a drive shaft axially connected thereto with a threaded end extending a predetermined distance through the port plate; and (d) at least one nut coupled to the shaft threaded end, the nut being for holding the port plate to the body with a predetermined degree of tension whereby the port plate is manually rotatable with respect to the body.

In a second predetermined embodiment, the invention provides an axially ported, automatically controlled variable volume gerotor pump, comprising:

(a) a first body having an annular interiorly disposed channel;

(b) a port plate rotatably coupled to the first body and covering the channel, the port plate having axially oriented fluid inlet and outlet ports communicatively connected to the channel;

(c) a second body rotatably coupled to the port plate, the second body further being fixed to the first body so that the port plate is disposed between the first body and the second body, the second body having fluid inlet and outlet apertures communicatively connected to the port plate inlet and outlet ports, respectively, and further having an annular control groove;

(d) a gerotor set including an outer rotor disposed in the first body channel and an inner rotor rotatably and centrally disposed with respect to the outer rotor and having a drive shaft axially connected thereto; and (e) a fluid volume control mechanism including:

(i) a spring connected to the body and to the port plate, the spring providing a predetermined rotational force to the port plate in a first direction;

(ii) a piston providing a predetermined rotational force to the port plate in a second direction, opposite the first direction, the piston being connected to an interiorly facing end of the port plate and being movably disposed in the second body control groove, and (iii) a fluid channel connected to the outlet port and to a predetermined point on the interiorly facing end of the port plate, adjacent the piston, the fluid channel directing fluid from the outlet port into the second body control groove to drive the piston in the control groove.

The features, benefits and objects of this invention will become clear to those skilled in the art by reference to the following description, claims and drawings.

DESCRIPTION OF THE PREFERRED EMBODIMENTS

The present invention provides an axially ported, variable flow gerotor-type gear pump. Manually and automatically controlled pump embodiments are provided The pump is useful in a variety of applications including automotive transmissions, power steering pumps and oil pumps.

Figure 1:
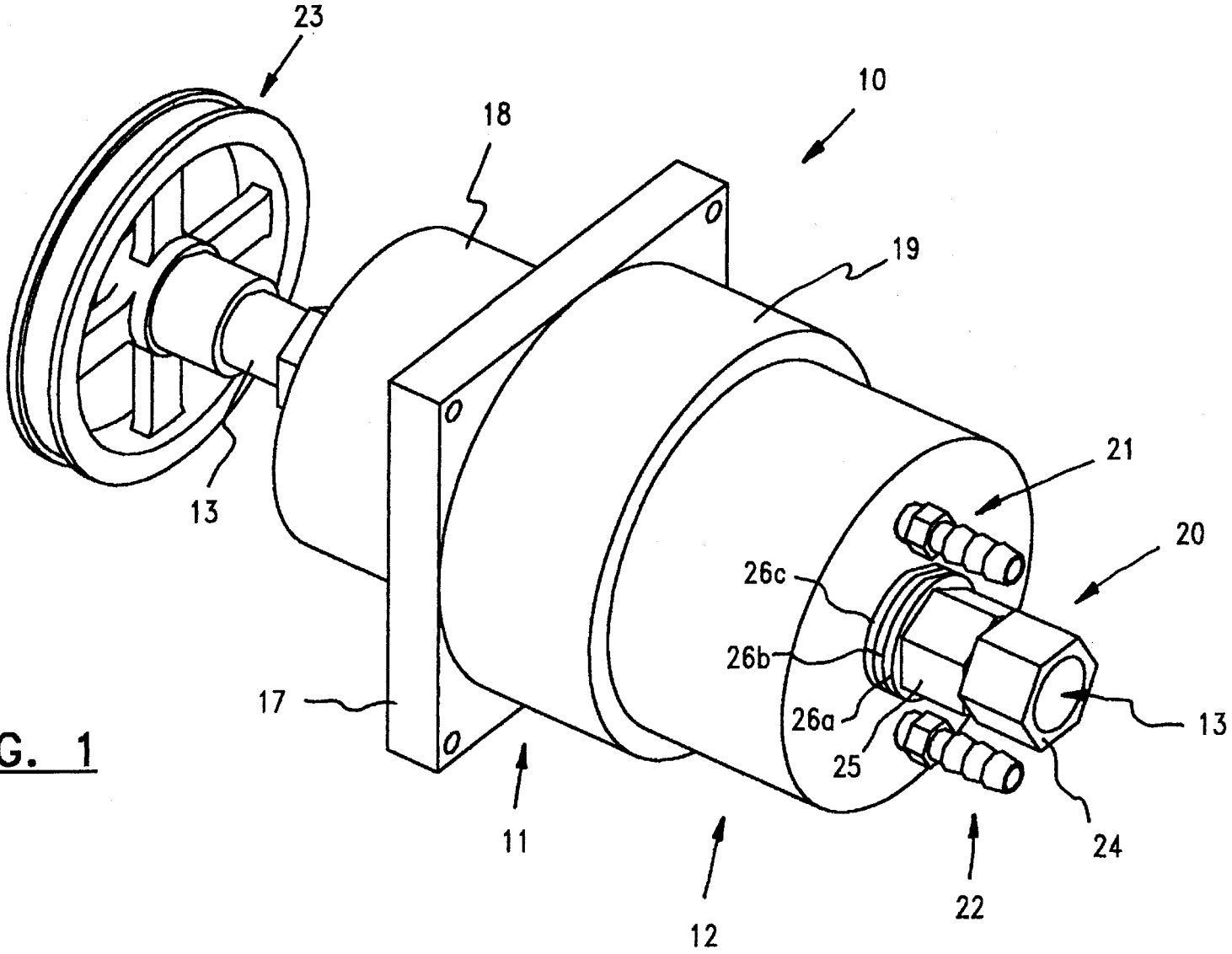
FIG. 1 is a perspective view of a gear pump in accordance with the present invention.
Figure 2:
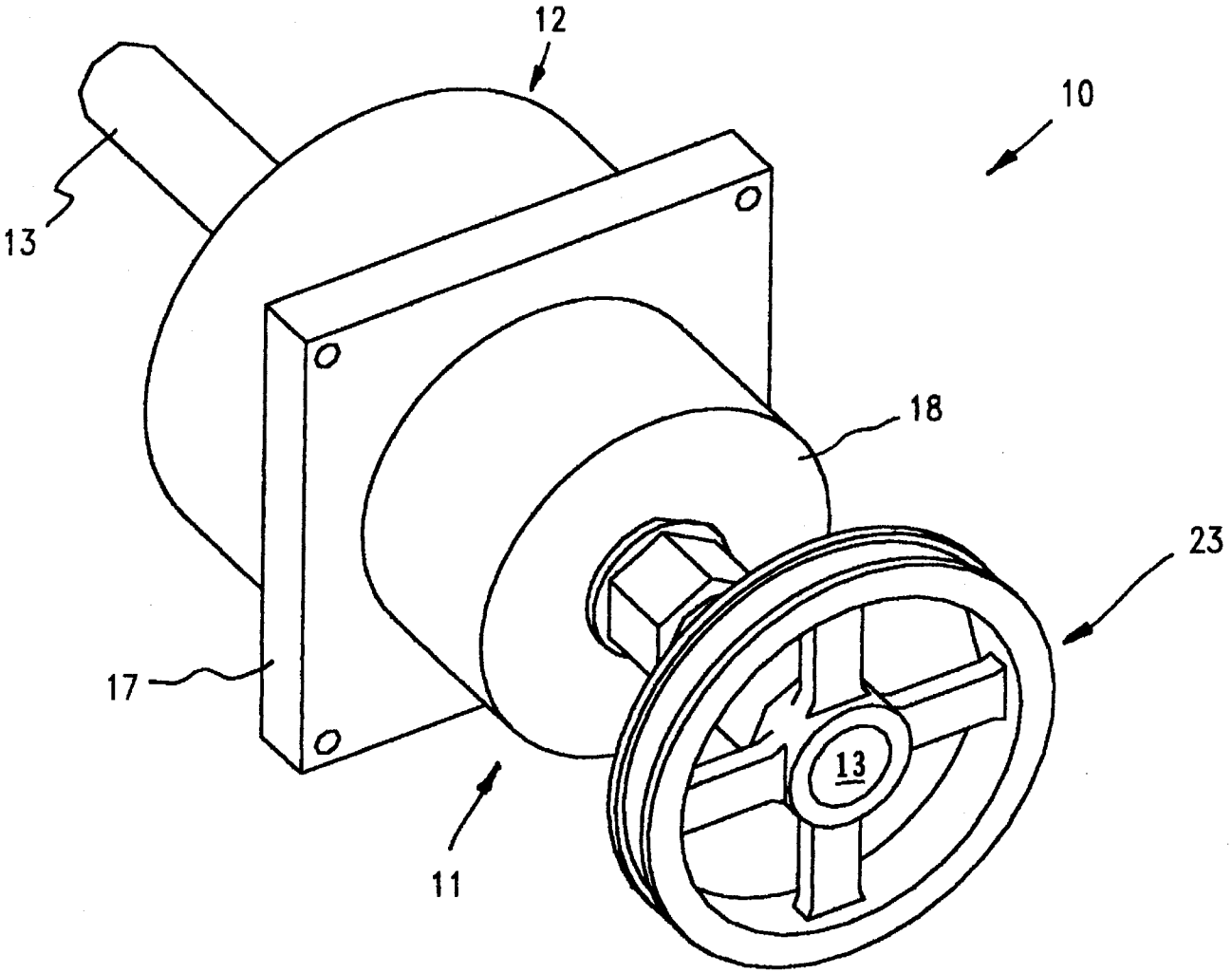
FIG. 2 is a perspective view of the opposite end of the pump shown in FIG. 1.

Referring to FIGS. 1 and 2, one embodiment of the gear pump apparatus 10 of the present invention basically comprises a pump body 11, a pump cover or plate 12 and a longitudinally oriented shaft 13. These members are constructed of high strength rigid metallic substances such as stainless steel or a similar material.

The pump body 11 includes a rectangular, somewhat thin mounting flange 17 which has several apertures for mounting to related apparatus. On one side of the mounting flange 17 is located a cylindrical bearing housing 18 and on the opposite side is located a cylindrical gear housing 19. The bearing housing 18 has an internal cavity which houses bearing means for rotatably retaining the shaft 13. The gear housing 19 also has a hollow cavity which houses gears as described further below.

The pump cover or port plate 12 is a cylindrical structure which is connected to the front face of the pump body gear housing 19 via a manually releasable retaining assembly 20 which is linked to a threaded terminal portion 14 of the shaft 13 shown extending longitudinally and concentrically with respect to and through the cover 12. The pump cover 12 contains ports as described below which are communicatively connected to connectors 21 and 22. The connectors 21 and 22 provide a means of communicatively connecting hose or tubing (not shown) coupled to related apparatus. The retaining assembly 20 permits rotational movement of the cover 12 with respect to the body 11 when it is loosened and locks the cover 12 in its adjusted position when tightened. The retaining assembly 20 comprises an outer hex nut 24, an inner nut 25 and a plurality of flat washers 26*a–c*. The washers 26 provide proper spacing of the nuts 25 and 24 on the shaft end 14 and further provide an increased area for frictionally engaging the surface of the cover 12. The inner nut 25 has a threaded interior which is complementary to the shaft threads 14. The inner nut 25 is the primary tightening means for the assembly 20. In a preferred mode of operation, the inner nut 25 is tightened to a level whereby the cover plate 12 is held closely to the body 11. In this position, the cover 12 is substantially leak-free, but is also able to be manually rotated with respect to the body 11. The outer nut 24 functions to lock the inner nut 25 in place, notwithstanding vibration and other forces, during operation.

The shaft 13 extends axially and concentrically through the body member 11 and the cover member 12. The shaft 13 is rotatable, but longitudinally and laterally fixed in place, primarily via beating means (not shown) disposed in the bearing housing 18. A pulley 23 or other connective structure is connected to a first end of the shaft 13 and provides a rotational driving force thereto. The opposite end of the shaft 13 extends through to the exterior of the cover 12 for coupling to the retaining assembly 20.

Figure 3:
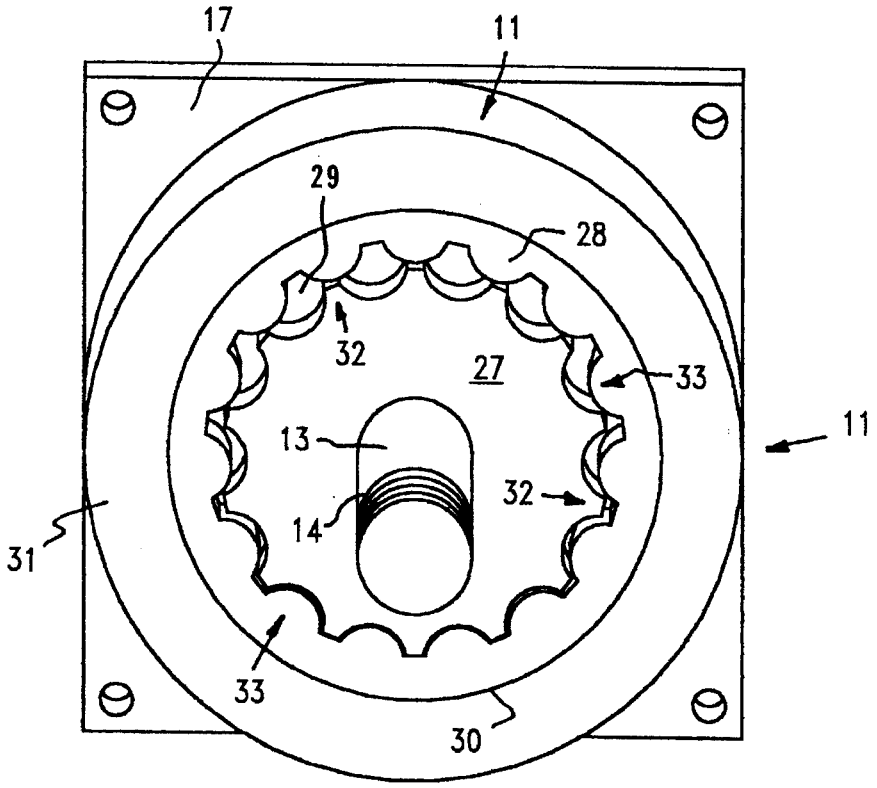
FIG. 3 is a view of the gerotor set of the pump.
Figure 4:
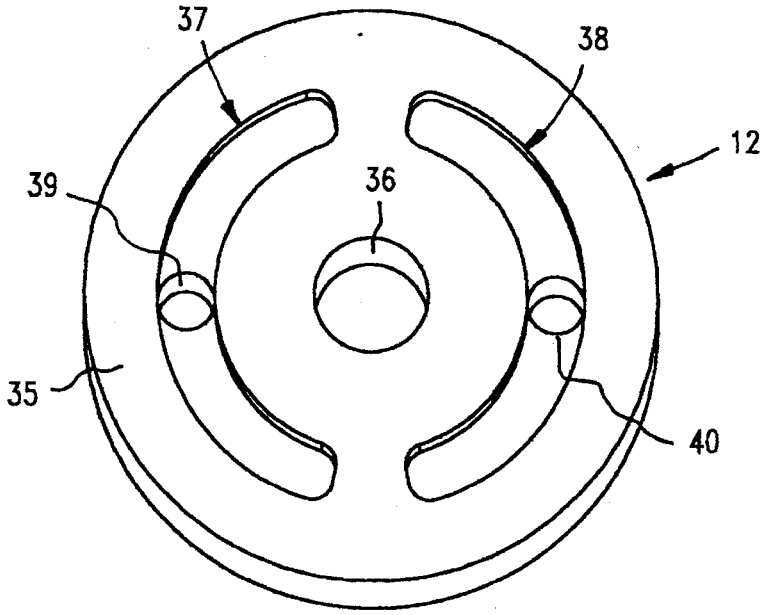
FIG. 4 is a view of the ports of the pump.

Referring to FIGS. 3 and 4, the body and cover 11 and 12 mate at respective flat circular faces 31 and 35. The cover 12 is rotatable with respect to the body 11 to quickly and easily adjust fluid flow upon loosening the retaining assembly 20. A ring shaped outer rotor or ring gear 28 having a plurality of internally oriented teeth or lobes 33 and a circular outer circumferential surface is disposed in the annular chamber or inner cavity 30 of the body 11. An inner rotor 27, sometimes referred to as a star or pinion gear, is also disposed in the cavity 30, centrally with respect to the outer rotor 28. The inner rotor 27 is preferably connected to the shaft 13 via a key or other means (not shown). The inner rotor 27 has a plurality of exteriorly oriented teeth or lobes 32. The inner rotor 27 has one less tooth 32 than the number of teeth 33 in the outer rotor 28. The teeth 33 and 34 generally mesh and are separated in predetermined regions of the rotors 27 and 28 to define cavities or teeth spaces 29.

As is best shown in FIG. 4, the cover or port plate 12 is a disc-shaped structure with spaced, elongated, symmetrical groove shaped inlet and outlet ports 37 and 38. Each port 37 and 38 is communicatively connected to an access aperture 39 and 40, respectively, which is open to the outside thee of the plate 12. The access apertures 39 and 40 function as inlet/outlet means for fluid coming into and out of the chamber 30 as is described further below. The ports 37 and 38 provide a means of adjusting the rate of fluid flow, also as described in detail below.

Importantly, the central axis of the inner and outer rotors 27 and 28 are eccentric with respect to one another. The inner rotor 27 is concentric with respect to the shaft 13, whereas the central axis of the outer rotor 28 (and hence the chamber 30), although parallel to the axis of the inner rotor 27 and shaft 13, is offset from such axis by a slight distance; in this embodiment of the apparatus 10, approximately one half the height of a tooth on a rotor 27 or 28 or on the order of 0.254 inches (1.0 cm.). The inner rotor 27 rotates with the shaft 13, in a clockwise direction for example. The outer rotor 28 is rotatable within the chamber 30 and driven in the same direction by the inner rotor 27.

Figure 5:
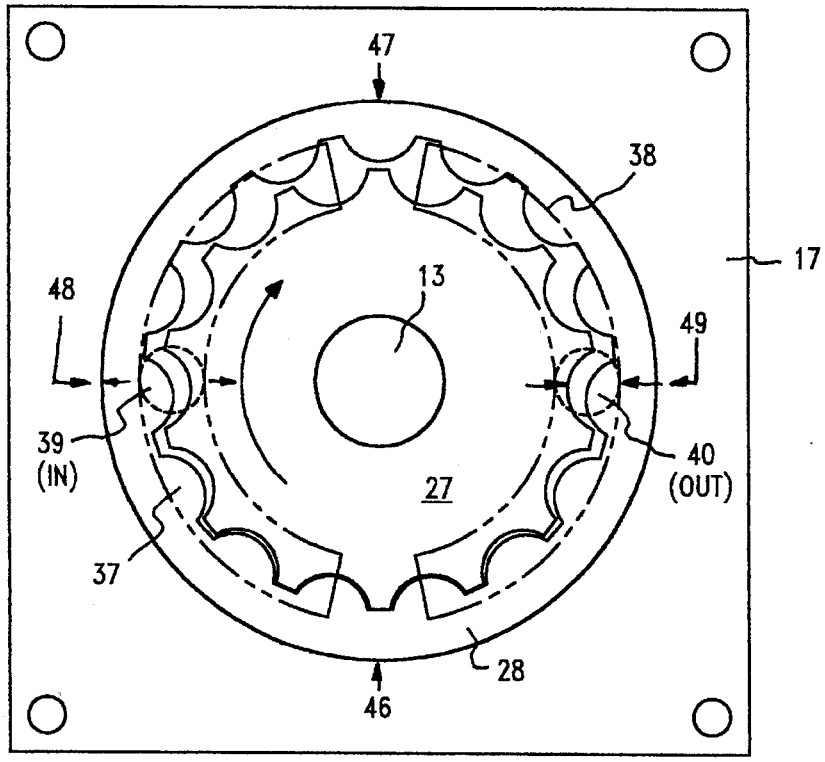
FIG. 5 is a diagrammatic view of the porting arrangement of the pump of this invention, shown with its input/output ports adjusted for maximum fluid flow.
Figure 6:
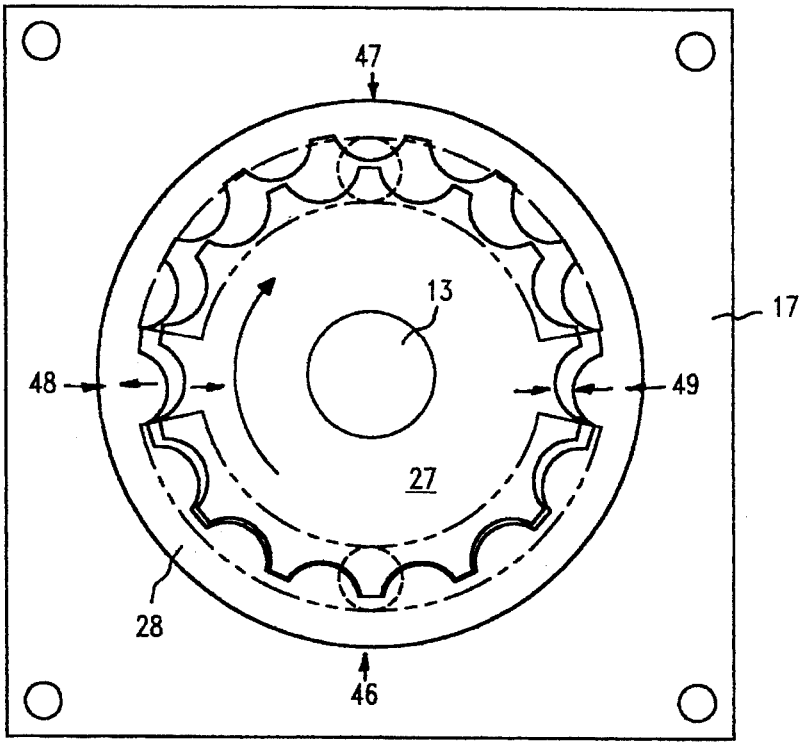
FIG. 6 is a diagrammatic view of the porting arrangement shown with its input/output ports adjusted for, near zero, minimum flow.
Figure 7:
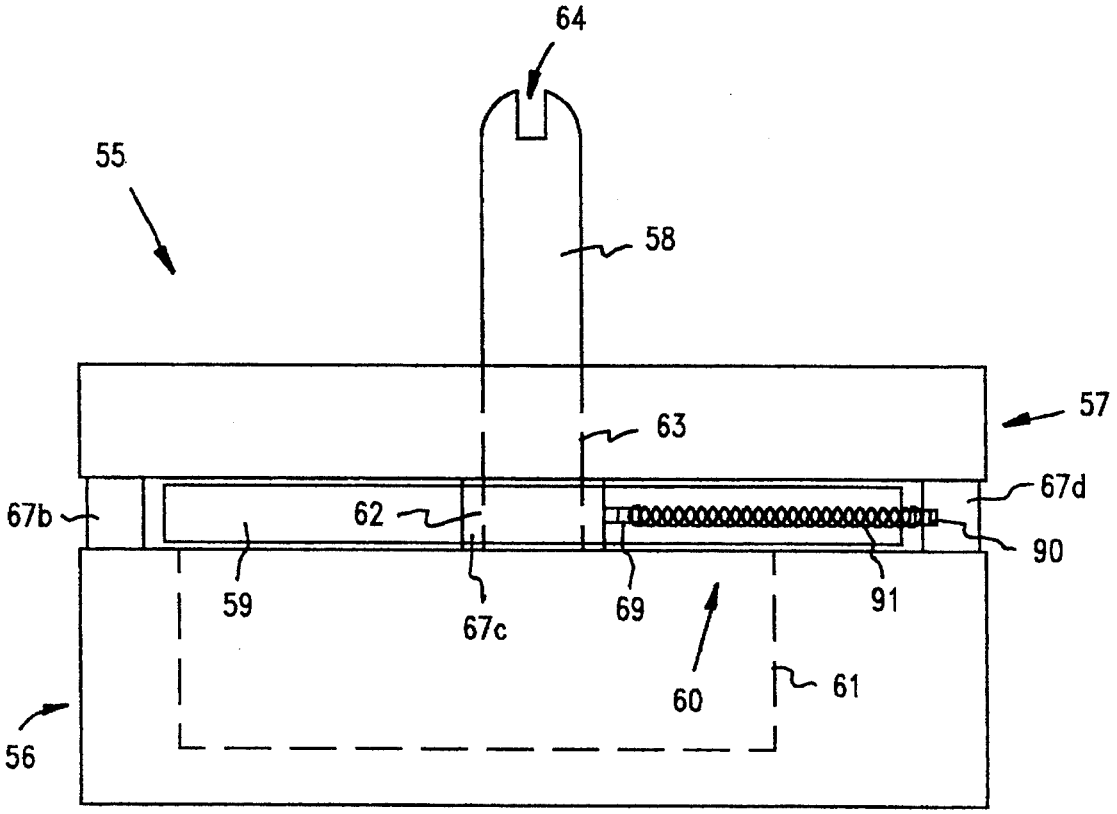
FIG. 7 is a side view of an embodiment of a pump assembly for an automotive engine oil pump and having a port plate control mechanism.

Referring also to FIGS. 5 and 6, due to the eccentricity of the rotors 27 and 28, at an initial point the rotor teeth 32 and 33 proximate a first side 46 of the chamber 30 are in full mesh while the teeth 32 and 33 on the opposite, second side 47 are completely out of mesh, thereby forming two nearly 180 degree regions of successively increasing sized tooth spaces or cavities 29 centered about sides 48 and 49. Upon rotation of the inner rotor 27, the cavities 29 of the region centered about side 48 successively expand while the cavities 29 of the region centered about side 49 contract. By positioning the ports 37 and 38 as shown in FIG. 5, fluid such as transmission or another hydraulic fluid, or oil, for example, is sucked into aperture 39 and forced out of aperture 40 at a maximum rate due to the exposure of port 37 to the full length of the region of cavity expansion and to the exposure of port 38 to the full length of the region of cavity contraction. In contrast, by aligning the ports 37 and 38 as shown in FIG. 6, fluid is input to aperture 39 and output from aperture 40 at a minimum rate to the exposure of each port 37 and 38 to an equivalent portion of both the expansion and contraction region. This balanced or neutral alignment results in near zero flow. As is readily apparent from this discussion, annular adjustment of the position of the ports 37 relative to the rotors 27 and 28 will produce a range of fluid flow rates between the maximum and minimum shown. Further, adjustment of the port 37 and 38 position greater than 180 degrees will result in a reversal of input and output.

Referring to FIGS. 7–14, an alternative embodiment of the gear pump apparatus 55, for use as an automobile oil pump, with automatic flow rate control. The pump 55 basically comprises a first or lower housing or body 56, a second upper housing 57, a shall 58 with end slot 64 for mating to external drive means (not shown), a port plate 59 and a plate control mechanism 60. The shall 58 rotates clockwise as viewed from the top side of the Figure. The lower housing 56 has an annular interior chamber 61 in which rotors (not shown) are disposed. The port plate 59 and upper housing have aligned apertures 62 and 63, respectively, through which the shaft 58 extends. No seals or gaskets are used in this embodiment, although fluid leakage is minimal. Such a pump design is contained in an outer housing, as is known in the art.

Figure 9:
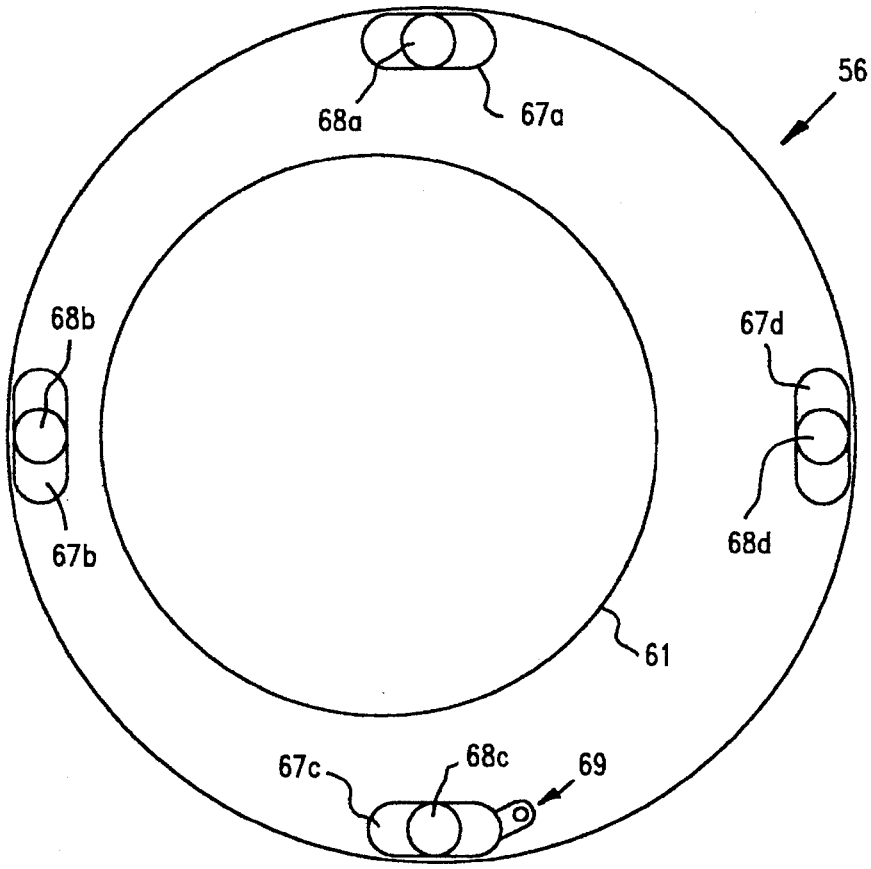
FIG. 9 is a top view of the lower housing.
Figure 8:
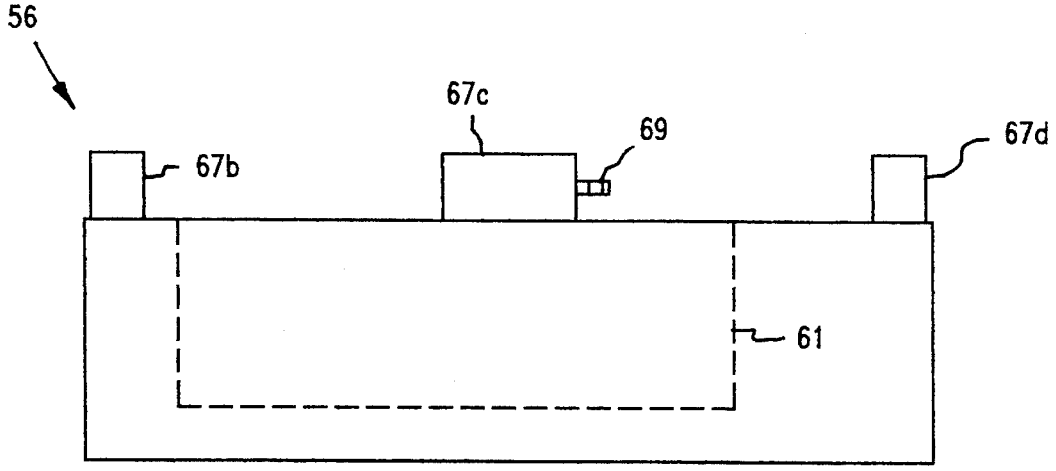
FIG. 8 is a side view of the lower housing of the pump assembly shown in FIG. 7.

Referring to FIGS. 8 and 9, the lower housing 56 is a cylindrical structure with the annular chamber 61 in one end thereof, off center with respect to the central axis of the cylindrical structure. Four near-circumferentially disposed spacers 67*a–d* of an equivalent predetermined length extend from the chamber end. Each spacer 67 has a threaded bolt receiving aperture 68*a–d* disposed therein. Spacer 67*c* has an eye 69 for attachment of a spring (not shown).

Figure 11:
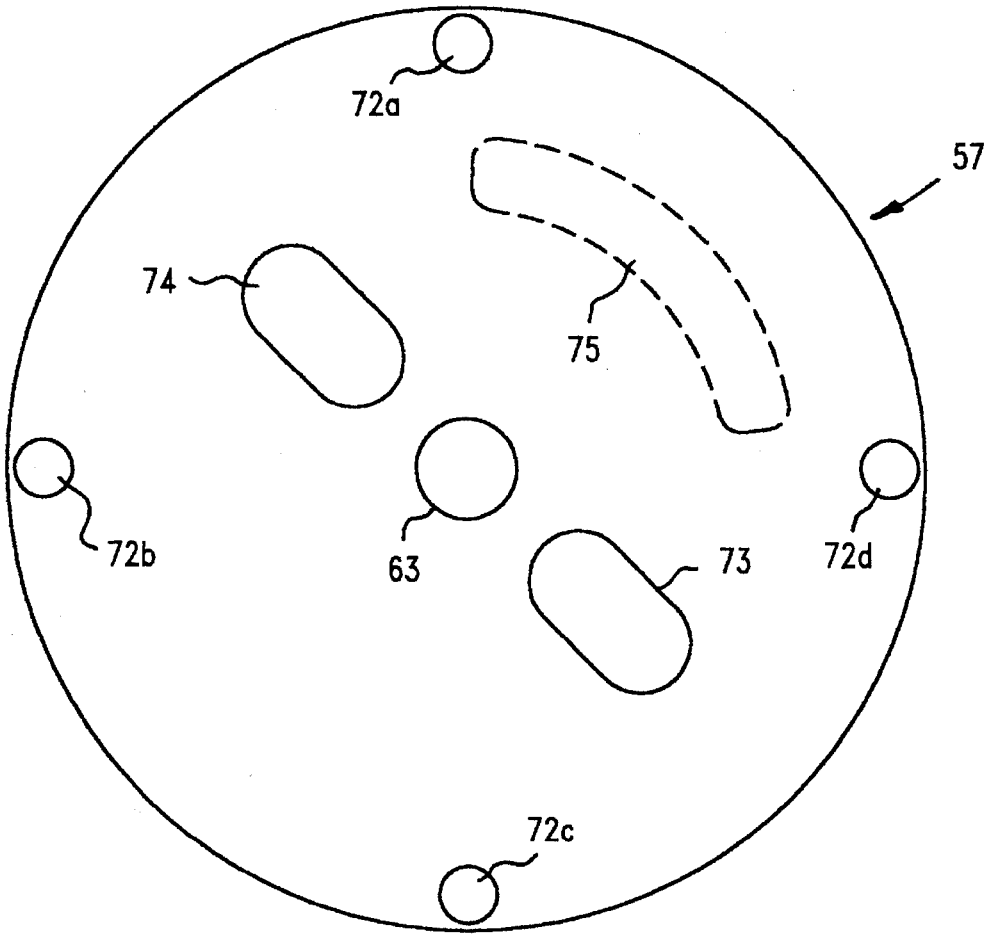
FIG. 11 is a top view of the upper housing.
Figure 10:
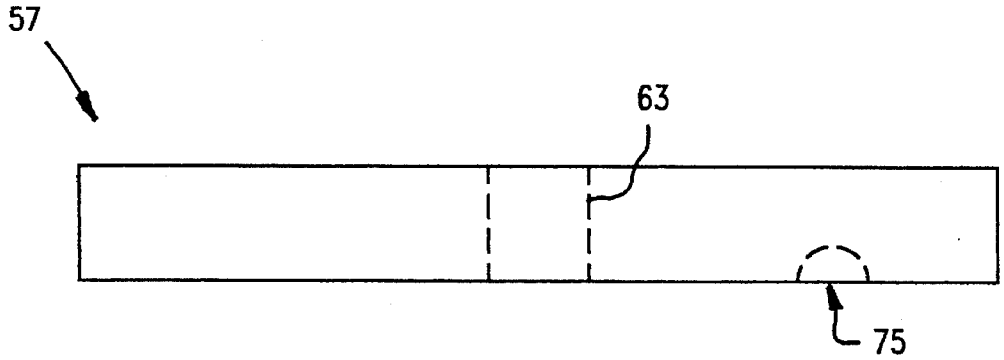
FIG. 10 is a side view of the upper housing of the pump assembly shown in FIG. 7.

Referring to FIGS. 10 and 11, the upper housing 57 is a relatively thin cylindrical structure with spaced, near circumferentially disposed bolt apertures 72*a–d*, a non-circular oil inlet aperture 73, an oil outlet aperture 74, and a halt-moon cylinder or groove 75 disposed in a bottom or interiorly facing end. The shaft 63 aperture is centrally disposed in the housing 57.

Figure 13:
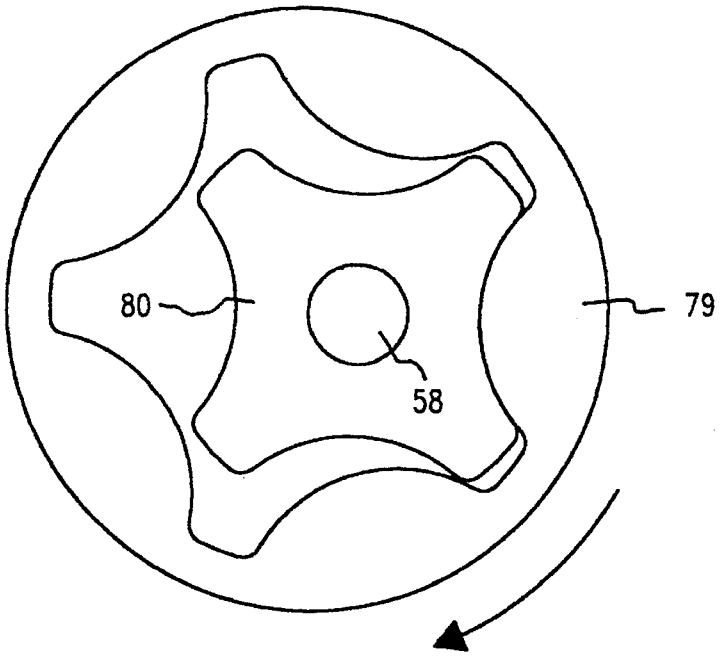
FIG. 13 is a top view of the combined inner and outer rotors of the pump assembly.
Figure 12:
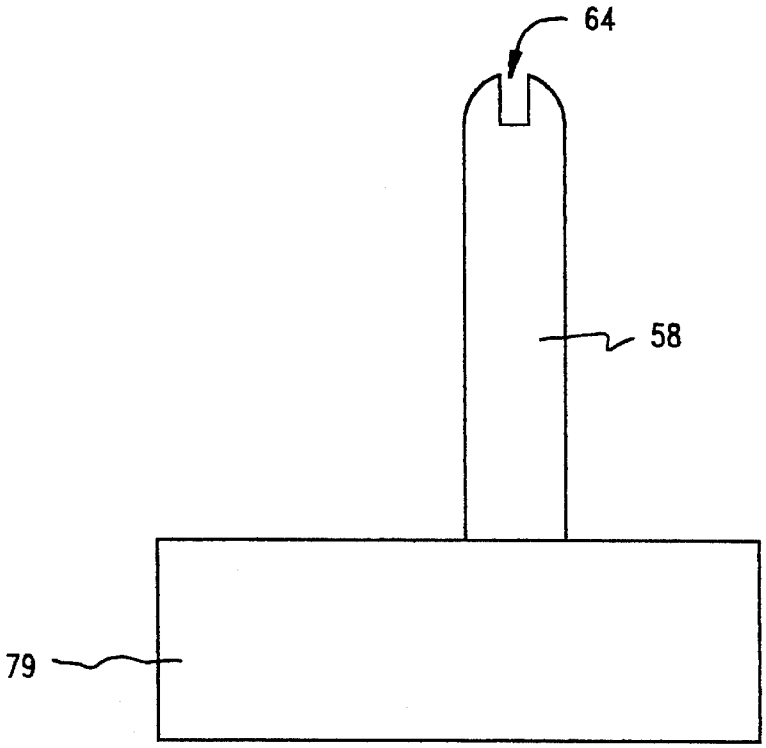
FIG. 12 is a side view of an inner rotor of the pump assembly shown in FIG. 7.

Referring to FIGS. 12 and 13, the rotors of the apparatus 55 include an outer rotor 79 and an inner rotor 80 coupled to shaft 58. The outer rotor 79 has five interiorly oriented teeth or lobes 81 and the inner rotor 80 has four exteriorly facing teeth 82. These rotors 79 and 80 define and cooperate as a gerotor set substantially as described with respect to the apparatus 10 shown in FIGS. 1–6. The gerotor set is principally disposed in chamber 61.

Figure 15:
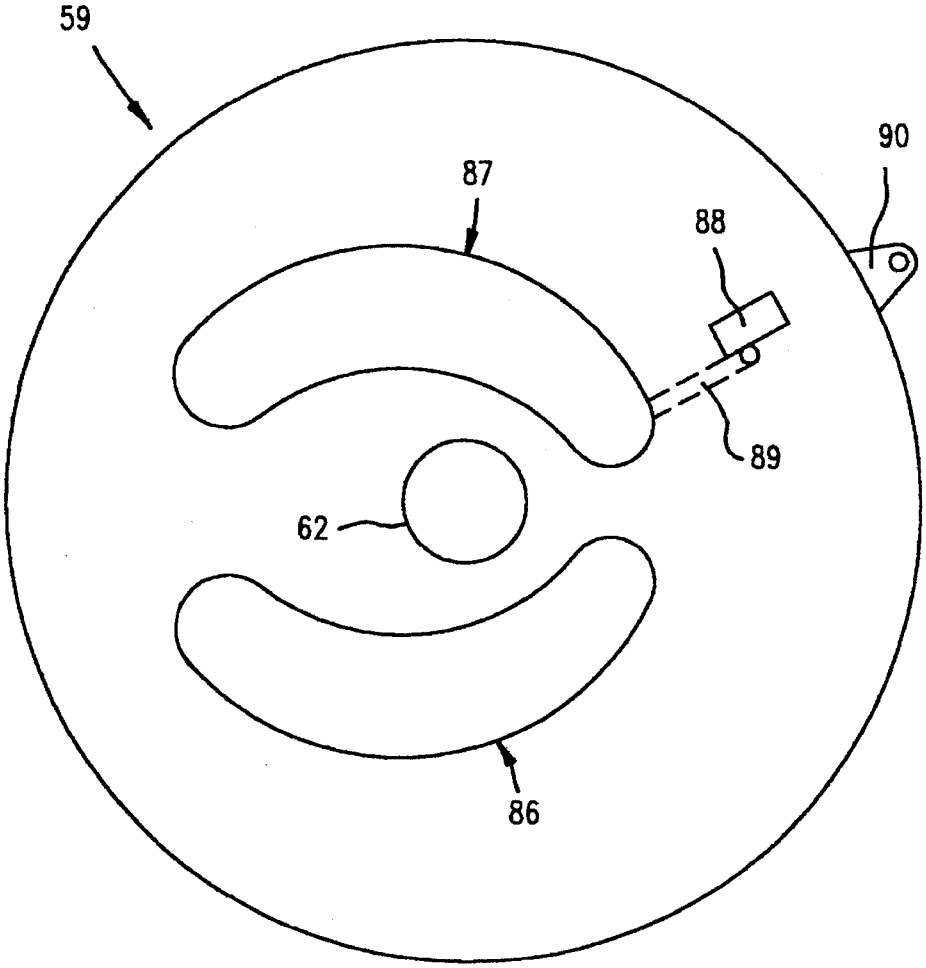
FIG. 15 is a top view of the port plate.
Figure 14:
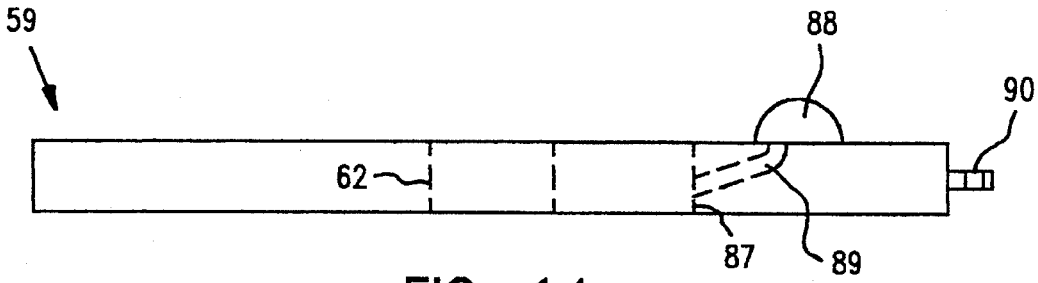
FIG. 14 is a side view of a port plate for use with the pump assembly.

Referring to FIGS. 14 and 15, the port plate 59 is a disc shaped structure wherein the shaft aperture 62 is axially disposed. Symmetrical annular inlet and outlet or pressure ports 86 and 87, respectively, of a predetermined configuration and which are non-concentric with respect to the plate 59. A semicircular, half:moon piston 88 is disposed on a top end surface of the plate 59. A port pressure duct 89 communicatively extends, within the plate 59 body, from the edge of the outlet or pressure port 87 to a point on the surface of the plate 59 immediately anterior to the piston 88. A spring attaching eye 90 is disposed at a predetermined circumferential point on the plate 59. A spring 91 is connected between the port plate eye 90 and the lower housing eye 69.

In operation, the spring 91 applies force to the port plate 59 in a direction to maximize the flow rate of the pump 55 while simultaneously the piston 88 applies force to the port plate 59 to minimize the flow rate. This automatic flow control action comes to a null when a set point pressure is reached where the spring 91 force matches the piston 88 force. Thus, the spring 91 three sets the pressure at which the pump 55 operates.

As many changes are possible to the embodiments of this invention utilizing the teachings thereof, the descriptions above, and the accompanying drawings should be interpreted in the illustrative and not the limited sense.

The invention claimed is:

1. A fluid pump, comprising a body having an annular interiorly disposed channel, a port plate coupled to said body and covering said channel, said port plate having axially oriented fluid inlet and outlet ports communicatively connected to said channel, an outer rotor disposed in said channel, an inner rotor rotatably and centrally disposed with respect to said outer rotor and having a drive shaft axially connected thereto, said drive shaft having a threaded end extending a predetermined distance through said port plate, and at least one nut coupled to said shaft threaded end, said nut being for holding said port plate to said body with a predetermined degree of tension whereby said port plate is rotatable with respect to said body.

2. The pump of claim 1, wherein said body is a cylindrical structure.

3. The pump of claim 2, wherein said body has external mounting means.

4. The pump of claim 2, wherein said body channel is non-axially aligned with said drive shaft.

5. The pump of claim 1, wherein said inlet and outlet ports each consist of an elongated annular groove of a predetermined longitudinally measured depth disposed in said port plate and a communicatively connected, longitudinally oriented external aperture.

6. The pump of claim 4, wherein said inner and outer rotors define a gerotor set.

7. The pump of claim 1, wherein said means to permit rotation further comprises a second nut to lock said nut in a predetermined longitudinal position on said shaft.

8. The pump of claim 7, wherein said means to permit rotation further comprises at least one washer disposed on said shaft and between said nut and said port plate.

9. An axially ported, manually adjustable variable volume gerotor fluid pump, comprising:

(a) a body having an annular interiorly disposed channel;

(b) a port plate coupled to said body and covering said channel, said port plate having axially oriented fluid inlet and outlet ports communicatively connected to said channel;

(c) a gerotor set including an outer rotor disposed in said channel and an inner rotor rotatably and centrally disposed with respect to said outer rotor and having a drive shaft axially connected thereto with a threaded end extending a predetermined distance through said port plate; and (d) at least one nut coupled to said shaft threaded end, said nut being for holding said port plate to said body with a predetermined degree of tension whereby said port plate is manually rotatable with respect to said body.

10. An axially ported, automatically controlled variable volume gerotor pump, comprising:

(a) a first body having an annular interiorly disposed channel;

(b) a port plate rotatably coupled to said first body and covering said channel, said port plate having axially oriented fluid inlet and outlet ports communicatively connected to said channel;

(c) a second body rotatably coupled to said port plate, said second body further being fixed to said first body so that said port plate is disposed between said first body and said second body, said second body having fluid inlet and outlet apertures communicatively connected to said port plate inlet and outlet ports, respectively, and further having an annular control groove;

(d) a gerotor set including an outer rotor disposed in said first body channel and an inner rotor rotatably and centrally disposed with respect to said outer rotor and having a drive shaft axially connected thereto; and (e) a fluid volume control mechanism including:

(i) a spring connected to said body and to said port plate, said spring providing a predetermined rotational force to said port plate in a first direction;

(ii) a piston providing a predetermined rotational three to said port plate in a second direction, opposite said first direction, said piston being connected to an interiorly facing end of said port plate and being movably disposed in said second body control groove, and (iii) a fluid channel connected to said outlet port and to a predetermined point on said interiorly facing end of said port plate, adjacent said piston, said fluid channel directing fluid from said outlet port into said second body control groove to drive said piston in said control groove.

11. A fluid pump, comprising a body having an annular interiorly disposed channel, a port plate coupled to said body and coveting said channel, said port plate having axially oriented fluid inlet and outlet ports communicatively connected to said channel, an outer rotor disposed in said channel, an inner rotor rotatably and centrally disposed with respect to said outer rotor and having a drive shaft axially connected thereto, a second body fixed to and spaced from said body so that said port plate is disposed between said body and said second body, said second body having fluid inlet and outlet apertures communicatively connected to said port plate inlet and outlet ports, respectively, and further having an annular control groove, and means to permit rotation of said port plate.

12. The pump of claim 11, wherein said means to permit rotation comprises:

(a) a spring connected to said body and to said port plate, said spring providing a predetermined rotational force to said port plate in a first direction;

(b) a piston providing a predetermined rotational force to said port plate in a second direction, opposite said first direction, said piston being connected to an interiorly facing end of said port plate and being movably disposed in said second body control groove, and (c) a fluid channel connected to said outlet port and to a predetermined point on said interiorly facing end of said port plate, adjacent said piston, said fluid channel directing fluid from said outlet port into said second body control groove to drive said piston in said control groove.

* * * * *